US007784112B2

(12) United States Patent
Shwartz et al.

(10) Patent No.: US 7,784,112 B2
(45) Date of Patent: Aug. 31, 2010

(54) HOLDER FOR A REMOVABLE GOLF BALL MARKER

(76) Inventors: Kenneth A. Shwartz, 49 Mattapoisett Neck Rd., Mattapoisett, MA (US) 02739; Charles Lord, 8 Alderberry La., Mattapoisett, MA (US) 02739

( * ) Notice: Subject to any disclaimer, the term of this patent is extended or adjusted under 35 U.S.C. 154(b) by 605 days.

(21) Appl. No.: 11/351,586

(22) Filed: Feb. 10, 2006

(65) Prior Publication Data

US 2006/0183569 A1 Aug. 17, 2006

Related U.S. Application Data

(60) Provisional application No. 60/652,500, filed on Feb. 11, 2005, provisional application No. 60/652,415, filed on Feb. 11, 2005, provisional application No. 60/666,930, filed on Mar. 31, 2005.

(51) Int. Cl.
*A41D 19/00* (2006.01)
*A63B 71/14* (2006.01)

(52) U.S. Cl. ..... 2/161.2; 2/161.1

(58) Field of Classification Search ..... 2/16, 2/20, 158, 159, 160, 161.1, 161.2, 161.4, 2/244, 917; 473/406; 224/183, 918
See application file for complete search history.

(56) References Cited

U.S. PATENT DOCUMENTS

| | | | | |
|---|---|---|---|---|
| 3,136,547 | A | 6/1964 | Schaper | |
| 3,139,690 | A | 7/1964 | Hait | |
| 3,208,123 | A | 9/1965 | Koos | |
| 3,233,802 | A | 2/1966 | Ludwick | |
| 3,923,215 | A | 12/1975 | Suzuki et al. | |
| 4,130,950 | A | 12/1978 | Bazzle et al. | |
| D252,289 | S | 7/1979 | Furin | |
| 4,386,774 | A | 6/1983 | Buckman | |
| 4,530,500 | A | 7/1985 | Kaymen | |
| 4,736,877 | A | 4/1988 | Clark | |
| 5,135,220 | A | 8/1992 | Baldoni | |
| 5,282,616 | A | 2/1994 | Stacavich-Notaro | |
| 5,305,999 | A * | 4/1994 | Tate | 473/406 |
| D350,179 | S | 8/1994 | Johnson | |
| 5,364,094 | A | 11/1994 | Mustion | |
| 5,417,426 | A * | 5/1995 | Bayer | 473/285 |
| D372,882 | S | 8/1996 | Goldman et al. | |
| 5,569,103 | A | 10/1996 | Sihn | |
| 5,643,114 | A | 7/1997 | Marcus | |
| 5,733,208 | A | 3/1998 | Fazekas | |

(Continued)

*Primary Examiner*—Gary L Welch
*Assistant Examiner*—Amber R Anderson
(74) *Attorney, Agent, or Firm*—Rajesh Vallabh; Foley Hoag LLP

(57) ABSTRACT

Disclosed is a holder for removably securing a magnetizable golf ball marker. The holder is preferably made of a resilient material. A magnet is secured to the holder such that the magnet is flush with the outer surface of the holder. The holder includes a raised ridge appropriately shaped to mate with and properly position the marker over the magnet. The marker is removed by sliding the marker away from the magnet and over the ridge or through a gap in the ridge. To aid in sliding the marker over the ridge, a sloped portion of the holder surface within the ridge causes the marker to tilt when pressure is applied to the marker to slide the marker off the magnet. A sloped portion adjacent a gap in the ridge can also tilt the marker for ease in grasping the marker when lifting the marker off the holder.

10 Claims, 2 Drawing Sheets

U.S. PATENT DOCUMENTS 5,898,946 A 5/1999 Keating et al.
5,930,839 A 8/1999 Schupp
5,996,116 A * 12/1999 Tate ..... 2/12
6,004,229 A 12/1999 Fazekas
6,022,280 A 2/2000 Arenburg et al.
6,163,889 A 12/2000 Tate
6,170,088 B1 1/2001 Tate
6,253,974 B1 7/2001 Park et al.
6,357,642 B1 3/2002 Marchessault et al.
6,422,955 B1 7/2002 Lopez
6,513,165 B1 2/2003 England et al.
6,569,039 B1 5/2003 Cope
6,599,205 B1 7/2003 Andrews et al.
6,820,282 B1 * 11/2004 England et al. ..... 2/161.1
6,966,851 B1 * 11/2005 England et al. ..... 473/406

* cited by examiner

HOLDER FOR A REMOVABLE GOLF BALL MARKER

RELATED APPLICATIONS

This application claims priority to, and incorporates by reference, the entire disclosures of U.S. Provisional Patent Application No. 60/652,500, filed on Feb. 11, 2005, U.S. Provisional Patent Application No. 60/652,415, filed on Feb. 11, 2005 and of U.S. Provisional Patent Application No. 60/666,930, filed on Mar. 31, 2005.

FIELD

The disclosed methods and systems relate to holders for removable display pieces, and more specifically to holders for removable golf ball markers.

BACKGROUND

Golf gloves and other golf related items, such as hats, belts, divot tools, etc., with removable ball markers have been in use for some time. In the case of golf gloves, the removable marker generally is positioned on the tab of the golf glove that is used to tighten the glove on the hand. The markers typically include a prong or pin that mates with a socket on the tab, or elsewhere on the glove. However, such markers require a tight fit of the prong within the socket so that the marker is not dislodged during play. A fair amount of force needs to be applied to then pry the marker from the socket for use. When returning the marker to the socket, care must be taken to properly align the prong or pin with the socket to avoid damage to either the prong or socket. In addition, the prong and socket arrangement is prone to corrosion or to jamming with foreign material, making it more difficult to remove and/or replace the marker.

In other types of arrangements, a magnetizable marker mates with a magnet embedded in the glove, hat, etc. Generally, a rim or ridge at least partially surrounds the location where the marker is placed, so as to guide the placement of the marker on the magnet. Without a rim or ridge configuration, the user may not properly position the marker on the magnet which can result in the marker becoming loose during play. While a larger magnet can be used in the glove to provide a greater placement area for the marker, a large magnet may interfere with the golfer's hand movement. However, as with the prong and socket arrangement, the rim or ridge configuration also requires the user to pry the marker from within the rim. Alternately, the marker can overlap the base where the magnet is located and the marker can be removed by pressing on the edge of the marker to cause it to tilt and the marker can then be removed.

SUMMARY

Disclosed is an improved holder for a golf ball marker. The marker is preferably made of a magnetizable material and the holder has a magnet affixed thereto to removably secure the marker. The holder is preferably made of molded rubber though can be of other resilient material. The magnet is secured to the rubber in such a way that the exposed surface of the magnet is substantially flush with the surrounding outer surface of the holder. The holder includes a raised ridge that defines the proper position of the ball marker and serves to assist in the placement of the marker on the magnet. In the case of a circular ball marker, the ridge is preferably circular in shape, though a substantially semi-circular ridge can be used, which allows the marker to be removed by sliding the marker away from the magnet without requiring the marker to be lifted off the magnet.

For markers of other shapes, the ridge may be appropriately shaped to mate with and position the marker over the magnet. In some embodiments, the ridge has a break therein so that the marker can be slid away from the magnet without requiring the marker to be lifted off the magnet. The ridge may be continuous or may include one or more gaps along its length. In cases where the ridge substantially surrounds the marker when positioned on the magnet, the marker can be removed by slightly bending the resilient holder and ridge while sliding the marker away from the magnet. The holder can be molded to create an incline such that the magnet moves onto the incline upon sliding away from the magnet. Alternately, the holder slopes away from the magnet such that downward pressure on one side of the marker raises the opposite side of the marker. The inclined orientation of the marker allows for easier removal of marker off the holder by facilitating the sliding of the marker over the ridge or through the gap in the ridge. Though described herein in relation to a golf glove, the holder can be fabricated on a hat, other articles of clothing, or golf paraphernalia, such as divot tools, golf bags, etc.

In one embodiment, a holder for a ball marker includes a magnet for magnetically holding the ball marker. The magnet positioned within an aperture in an outer surface of the holder and the aperture extends at least partway through the holder such that an outer surface of the magnet is substantially flush with the outer surface of the holder surrounding the magnet. A ridge extends at least partway around the magnet on the outer surface of the holder. The ridge is shaped to correspond with a shape of the ball marker so as to define a placement area for the ball marker on the holder. The holder is formed of a resilient material, such that deformation of the ridge allows for removal of the ball marker from the holder by sliding the ball marker away from the magnet.

In some embodiments, the aperture extends through the holder, and the holder further includes a first covering that has an indentation and a flange portion surrounding the indentation. The indentation is shaped to fit within the aperture with the flange portion abutting and affixed to an inner surface of the holder. The magnet can be held within the indentation. A second covering can be affixed over the flange portion of the first covering and can extend over the indentation and the magnet to secure the magnet within the indentation.

In some embodiments, the holder includes a sloped portion on its outer surface between the aperture and the ridge, which slopes away from the aperture and down towards the ridge, such that the ball marker is spaced apart from the sloped portion when the ball marker is placed on the magnet.

The holder can be secured to an article of clothing, such as a golf glove, wherein the holder can be secured to a closure flap of the golf glove. The closure flap can be formed of a hook and loop fastener material and the holder can be secured to the hook and loop fastener material such as by stitching.

In some embodiments, the ridge can include a gap section extending substantially a width of the ball marker around the magnet. The holder can include a sloped portion of the outer surface of the holder adjacent the gap section, such that sliding the ball marker away from the magnet and through the gap section results in the ball marker being positioned on the sloped portion for removal of the ball marker from the holder.

In one embodiment, a holder for a ball marker on a golf glove includes a magnet for magnetically holding the ball marker, wherein the magnet is positioned within an aperture in an outer surface of the holder. The aperture can extend at least partway through the holder such that an outer surface of the magnet is substantially flush with the outer surface of the holder surrounding the magnet. A ridge can extend at least partway around the magnet on the outer surface of the holder with the shape of the ridge corresponding to a shape of the ball marker so as to define a placement area for the ball marker on the holder. The ridge can have a gap section extending around the magnet substantially a width of the ball marker. Further, the holder can include a sloped portion of the outer surface of the holder adjacent the gap section, such that sliding the ball marker away from the magnet and through the gap section results in the ball marker being positioned on the sloped portion for removal of the ball marker from the holder.

The aperture can extend through the holder and the holder can include a first covering having an indentation and a flange portion surrounding the indentation. The indentation can be shaped to fit within the aperture for holding the magnet therein, with the flange portion abutting and affixed to an inner surface of the holder. A second covering can be affixed over the flange portion and extend over the indentation and the magnet to secure the magnet within the indentation.

The holder can be secured to a closure flap of the golf glove. The closure flap can be formed of a hook and loop fastener material and the holder is secured to the hook and loop fastener material by stitching.

In one embodiment, a method for making a holder for a ball marker comprises forming the holder of a resilient material, forming a ridge on an outer surface of the holder, a shape of the ridge corresponding to a shape of the ball marker so as to define a placement area for the ball marker on the outer surface of holder, forming an aperture in the outer surface of the holder such that the ridge extends at least partway around the aperture and the aperture extends at least partway through the holder, forming a sloped portion of the outer surface of the holder between the aperture and the ridge, the sloped portion sloping up from the ridge towards the aperture in a direction increasing a thickness of the holder, providing a magnet for magnetically holding the ball marker, and positioning the magnet within the aperture in the outer surface of the holder, such that an outer surface of the magnet is substantially flush with the outer surface of the holder surrounding the magnet, such that the ball marker is spaced apart from the sloped portion when the ball marker is placed on the magnet.

DESCRIPTION

To provide an overall understanding, certain illustrative embodiments will now be described; however, it will be understood by one of ordinary skill in the art that the apparatus described herein can be adapted and modified to provide apparatus for other suitable applications and that other additions and modifications can be made without departing from the scope of the systems and methods described herein.

Unless otherwise specified, the illustrated embodiments can be understood as providing exemplary features of varying detail, and therefore, unless otherwise specified, features, components, modules, and/or aspects of the illustrations can be otherwise combined, separated, interchanged, and/or rearranged without departing from the disclosed systems or methods. Additionally, the shapes and sizes of components are also exemplary and unless otherwise specified, can be altered without affecting the disclosed systems or methods. Throughout the entirety of the present disclosure, use of the articles "a" or "an" to modify a noun can be understood to be used for convenience and to include one, or more than one of the modified noun, unless otherwise specifically stated.

Figure 1:
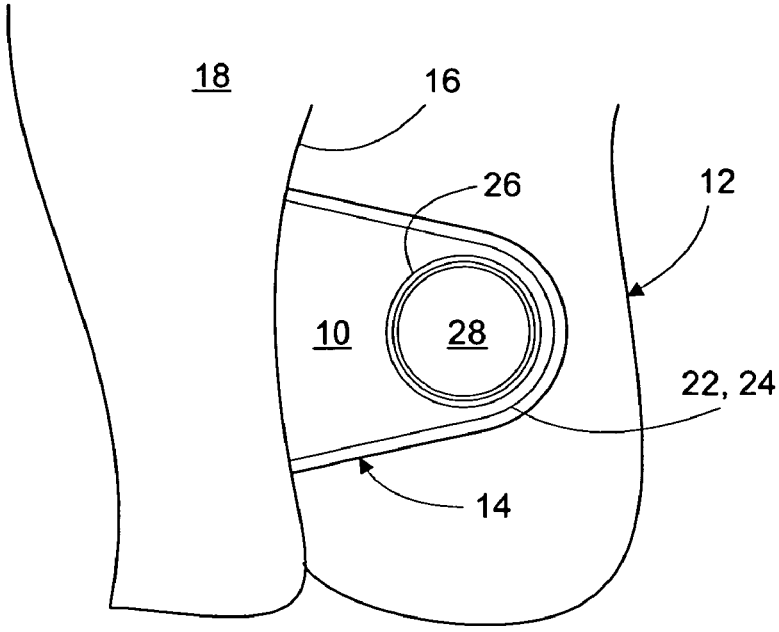
FIG. 1 is a partial pictorial view of a back surface of a golf glove with a holder and golf ball marker mounted thereon.

FIG. 1 illustrates a holder 10 mounted on a golf glove 12. For illustrative purposes, the holder 10 is described for use with golf glove 12, though the features of the holder described herein are equally applicable when mounted on other golf accessories and/or sport apparel. In the exemplary embodiment of FIG. 1, holder 10 is mounted on the closure assembly of the glove 12, though other locations on the glove 12 can be contemplated. As is known, such closure assemblies can include a tab or flap 14 attached to one edge 16 of a slit opening on the rear face 18 of the glove 12. The flap 14 mates with a corresponding portion on the opposite side of the slit opening. Preferably, the flap 14 can have an inner surface of fabric loop fastener material (not shown in FIG. 1) and the corresponding portion can have the mating hook fastener material on its outer surface, though the fastener materials can be interchanged. Other types of closure devices, including snaps, buttons and the like can be used. The details of such closure assemblies as well as the glove construction are well known and need not be described further.

Figure 2:
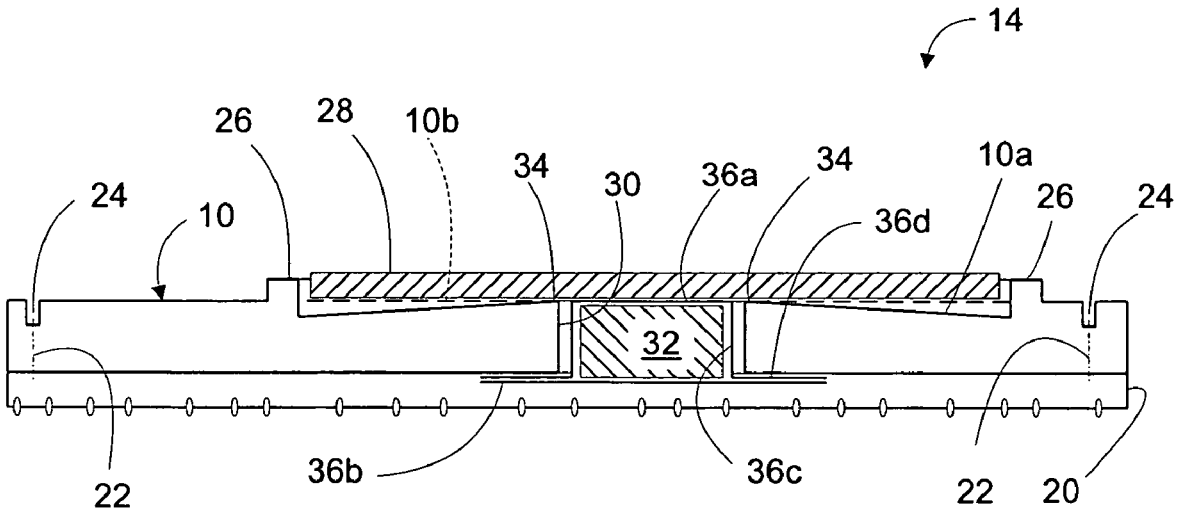
FIG. 2 is a cross-sectional view of the holder attached to the glove.

As shown more clearly in FIG. 2, resilient holder 10 is firmly affixed to the loop fastener material 20 to form the outer surface of flap 14 such as by an adhesive or by stitching 22 about the perimeter of holder 10. The flap 14 is then stitched or otherwise firmly attached to the edge 16. For greater aesthetics, the stitching 22 can be placed in a groove 24 molded into holder 10. Holder 10 also includes a raised ridge 26 molded thereon that defines the proper position of the ball marker 28 on holder 10. Ridge 26 is shaped to conform to the contours of marker 28. As illustrated for the embodiment shown in the figures, and as generally preferred in the art for ball markers, marker 28 has a rounded shape and ridge 26 has a corresponding rounded shape. Other shapes for ball marker 28 can be contemplated, with ridge 26 molded to have a corresponding shape.

Holder 10 is molded with an aperture 30 or hole at least partway therethrough, located within the position defined by ridge 26. Magnet 32 is secured within aperture 30 such that magnet 32 is generally flush with the edge 34 of aperture 30 and with the outer surface of holder 10 that surrounds ridge 26. Preferably, the outer surface 10*a* of holder 10 between aperture 30 and ridge 26 is molded to slope down away from aperture 30, such that the interior height of ridge 26 is slightly greater than the exterior height. However, in some embodiments, the outer surface 10*b* of holder 10 between aperture 30 and ridge 26 is also generally flush with magnet 32, as indicated by dashed lines in FIG. 2, and as will be described in relation to FIGS. 3 and 4.

For the embodiment illustrated in FIG. 2, aperture 30 extends completely through holder 10 and magnet 32 is secured by being sandwiched between two layers of a covering material 36*a*, 36*b*. The outer layer 36*a* of the covering material 36 has an indentation 36*c* that generally conforms to the shape of the magnet 32, and into which the magnet 32 fits. The depth of the indentation 36*c* generally conforms to the thickness of holder 10. The edge of outer layer 36*a* extends past that of the magnet 32 to form a flange 36*d* about the magnet 32. The inner layer 36*b* generally conforms to the shape of the outer layer 36*a* and generally has no indentation. However, the inner layer 36*b* can have a slight indentation if the thickness of the magnet 32 is greater than that of holder 10. The two layers 36*a* and 36*b* are affixed to one another at flange 36*d* with the magnet 32 within the indentation 36*c* between the two layers 36*a*, 36*b*. Preferably an adhesive is used to affix the layers 36*a* and 36*b* together, though they may be fused, crimped, clipped, or otherwise held together.

Prior to affixing the holder 10 to the fastener material 20, the magnet 32 and covering material layers 36*a*, 36*b* can be placed beneath the holder 10 such that the outer layer 36*a* and magnet 32 protrude through the aperture 30 and the flange 36*d* is in contact with the inner surface of holder 10. The flange 36*d* can be secured to the holder 10 with an adhesive or other affixing means. The fastener material 20 can then be affixed to the holder 10. Preferably, outer layer 36*a* is a clear plastic such that a logo or other design can be placed on the magnet 32 and be visible to the user. In other embodiments, covering layers 36*a*, 36*b* need not be provided and magnet 32 can be fabricated to include its own flange that can be affixed to the inner surface of holder 10. Other means or combinations thereof can be used for holding the magnet 32 in place, e.g., friction fitting and tape.

In use, the combination of the resilient ridge 26 and the sloping surface adjacent the magnet 32 allows for easy removal of the marker 28. A slight downward pressure applied on the marker 28 against the slope raises the edge of the marker 28 opposite the magnet 32. The raised edge allows the marker 28 to be slid over the magnet 32 and over the ridge 26. Even if the edge of the marker 28 is not raised over the ridge 26, the resilient nature of the ridge 26 allows the ridge to deform when the marker 28 is pulled over the ridge 26. For the case of a flush outer surface 10*b*, removal of the ball marker 28 is accomplished by flexing the resilient flap 14 and holder 10 such that an edge the ball marker 28 is similarly raised.

Figure 3:
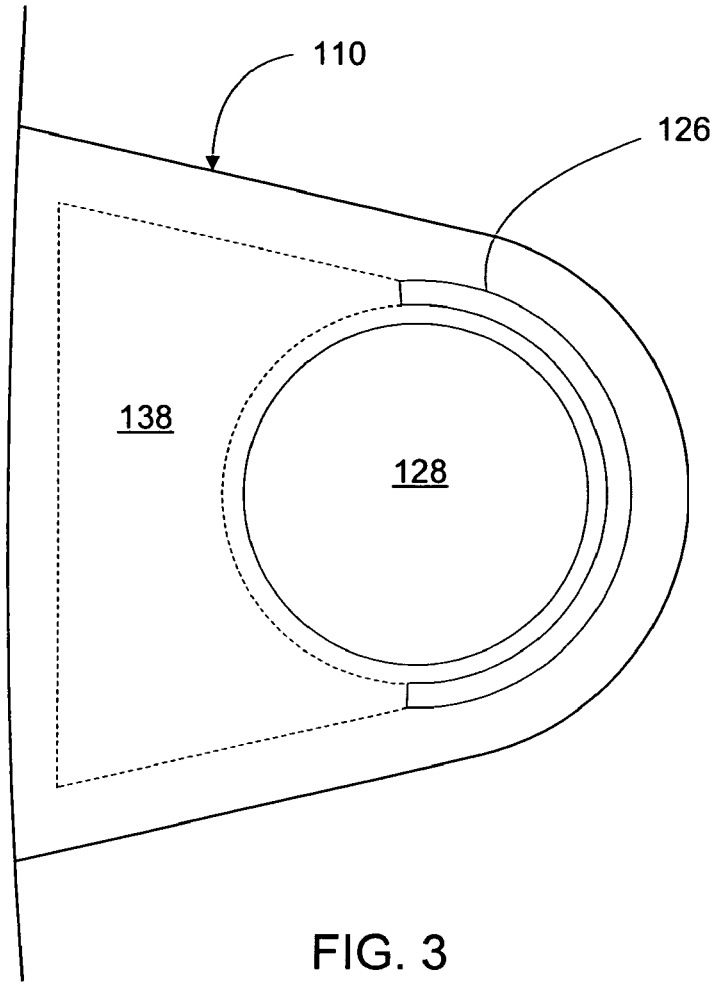
FIG. 3 is a partial pictorial view of an embodiment of a holder and golf ball marker mounted on a golf glove.
Figure 4:
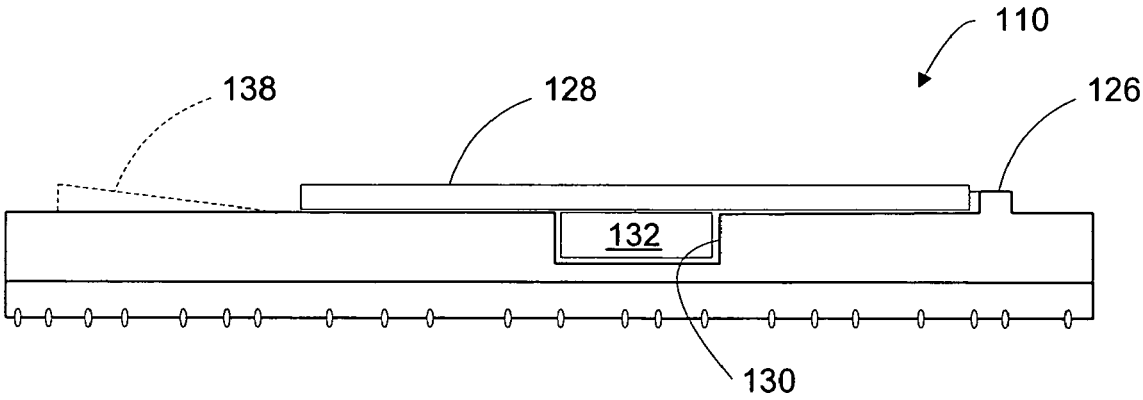
FIG. 4 is a cross-sectional view of another embodiment of the holder.

FIGS. 3 and 4 illustrate views of an embodiment of a holder 110 wherein a portion of ridge 126 has been removed to form a gap therein. FIG. 4 further illustrates an alternative mounting for magnet 132 wherein holder 110 includes an aperture or depression 130 that does not extend through holder 110, as opposed to the aperture 30 shown in FIG. 2. As in the embodiment of FIG. 2, the upper surface of the magnet 132 when seated in depression 130 is generally flush with the surrounding upper surface of holder 110. Magnet 132 can be affixed within depression 130 by means of adhesive, press fitting, tape, barbs, etc., or combinations thereof. The removed portion or gap of ridge 126 further assists in the removal of marker 128 in that the edge of marker 128 need not be raised over a ridge portion when sliding the marker 128 off the magnet 132 in the direction of the gap. Generally, the ridge 126 can have a gap that extends approximately the width of the ball marker so as to allow the marker 132 to be slid through the gap without encountering a ridge portion. For the case of a circular marker 132, as illustrated in FIG. 4, the gap can extend such that the shape of ridge 126 is substantially the same as, or slightly greater than a semi-circle. Such a configuration can be beneficial when holder 110 and/or ridge 126 are fabricated of less resilient materials. Alternately or additionally, an incline 138 can be molded into the surface of the holder 110 (shown dashed in FIG. 3) adjacent the gap. As the marker 128 is slid onto the incline 138, the leading edge of marker 128 is lifted off the surface of holder 110 to further facilitate removal of the marker 128.

Although the holder has been described relative to specific embodiments thereof, it is not so limited. Obviously many modifications and variations may become apparent in light of the above teachings. Elements, components, modules, and/or parts thereof that are described and/or otherwise portrayed through the figures to communicate with, be associated with, and/or be based on, something else, can be understood to so communicate, be associated with, and or be based on in a direct and/or indirect manner, unless otherwise stipulated herein.

Many additional changes in the details, materials, and arrangement of parts, herein described and illustrated, can be made by those skilled in the art.

What is claimed is:

1. A holder for a ball marker, comprising:

a magnet for magnetically holding the ball marker, the magnet positioned within an aperture in an outer surface of the holder, the aperture extending at least partway through the holder such that an outer surface of the magnet is substantially flush with the outer surface of the holder surrounding the magnet, a ridge extending at least partway around the magnet on the outer surface of the holder, a shape of the ridge corresponding to a shape of the ball marker so as to define a placement area for the ball marker on the holder, wherein the outer surface of the holder extending between the ridge and the aperture is gradually inclined from said ridge to the aperture, wherein the magnet and aperture are generally centrally located relative to said ridge, and wherein the outer surface of the holder that is gradually inclined extends generally around the magnet and aperture, and wherein the holder is formed of a resilient material, such that deformation of the ridge allows for removal of the ball marker from the holder by sliding the ball marker away from the magnet.

2. The holder of claim 1, wherein the aperture extends through the holder, and further comprising:

a first covering having an indentation and a flange portion surrounding the indentation, the indentation shaped to fit within the aperture with the flange portion abutting and affixed to an inner surface of the holder, the indentation holding the magnet therein, and a second covering affixed over the flange portion and extending over the indentation and the magnet therein to secure the magnet within the indentation.

3. The holder of claim 1, wherein the ridge includes a gap section extending substantially a width of the ball marker around the magnet.

4. The holder of claim 3, further comprising a sloped portion of the outer surface of the holder adjacent the gap section, such that sliding the ball marker away from the magnet and through the gap section results in the ball marker being positioned on the sloped portion for removal of the ball marker from the holder.

5. The holder of claim 4, wherein the aperture extends through the holder, and further comprising:

a first covering having an indentation and a flange portion surrounding the indentation, the indentation shaped to fit within the aperture with the flange portion abutting and affixed to an inner surface of the holder, the indentation holding the magnet therein, and a second covering affixed over the flange portion and extending over the indentation and the magnet therein to secure the magnet within the indentation.

6. A holder for a ball marker on a golf glove, comprising:

a magnet for magnetically holding the ball marker, the magnet positioned within an aperture in an outer surface of the holder, the aperture extending at least partway through the holder such that an outer surface of the magnet is substantially flush with the outer surface of the holder surrounding the magnet, a ridge extending around the magnet on the outer surface of the holder, a shape of the ridge corresponding to a shape of the ball marker so as to define a placement area for the ball marker on the holder, wherein the outer surface of the holder extending between the ridge and the aperture is gradually inclined from said ridge to the aperture to facilitate removal of the ball marker from the holder, wherein the magnet and aperture are generally centrally located relative to said ridge, and wherein the outer surface of the holder that is gradually inclined extends generally around the magnet and aperture.

7. The holder of claim 6, wherein the aperture extends through the holder, and further comprising:

a first covering having an indentation and a flange portion surrounding the indentation, the indentation shaped to fit within the aperture with the flange portion abutting and affixed to an inner surface of the holder, the indentation holding the magnet therein, and a second covering affixed over the flange portion and extending over the indentation and the magnet therein to secure the magnet within the indentation.

8. The holder of claim 6, wherein the holder is secured to a closure flap of the golf glove.

9. The holder of claim 8, wherein the closure flap is formed of a hook and loop fastener material and the holder is secured to the hook and loop fastener material by stitching.

10. The holder of claim 6, wherein the holder comprises a resilient material.

* * * * *